United States Patent [19]

Cornwall et al.

[11] 4,286,863

[45] Sep. 1, 1981

[54] PRESSURE FUSING APPARATUS FOR AN ELECTROSTATIC REPRODUCING MACHINE

[75] Inventors: Frank H. Cornwall, Fairfield; William A. Ross, Darien, both of Conn.

[73] Assignee: Pitney Bowes Inc., Stamford, Conn.

[21] Appl. No.: 73,837

[22] Filed: Sep. 10, 1979

[51] Int. Cl.[3] ..... G03G 15/00

[52] U.S. Cl. ..... 355/3 FU; 432/60

[58] Field of Search ..... 355/3 FU; 219/216, 388; 432/60; 271/183, 197, 229, 231

[56] References Cited

U.S. PATENT DOCUMENTS

| | | | |
|---|---|---|---|
| 3,588,095 | 6/1971 | Ward et al. | 271/34 |
| 3,794,417 | 2/1974 | Machmer | 355/3 FU |
| 3,874,894 | 4/1975 | Pedersen | 355/3 FU |
| 4,188,109 | 2/1980 | Idenawa et al. | 355/3 FU |

FOREIGN PATENT DOCUMENTS

| | | | |
|---|---|---|---|
| 52-4845 | 1/1977 | Japan | 355/3 FU |

OTHER PUBLICATIONS

Xerox Disclosure Journal, vol. 4, No. 2, p. 215, 4–1979.

*Primary Examiner*—William H. Beha, Jr.
*Attorney, Agent, or Firm*—Peter Vrahotes; William D. Soltow, Jr.; Albert W. Scribner

[57] ABSTRACT

A pressure fusing apparatus for an electrostatic reproducing machine having a vacuum hold-down plenum across which a sheet is guided before being passed through pressure fuser rollers. It has been found that passing the sheet over such a plenum under vacuum reduces the frequency of creasing in the sheets as they pass through the rollers.

4 Claims, 2 Drawing Figures

PRESSURE FUSING APPARATUS FOR AN ELECTROSTATIC REPRODUCING MACHINE

BACKGROUND OF THE INVENTION

In the field of electrostatic copying, a recent development that is coming into more favor is the technique of fusing by applying pressure to an imaged area without the use of heat. In the electrostatic copying process, a photoconductive surface is first charged then exposed to an original, whereby an image area is formed on the photoconductive surface. Dry toner may then be placed in contact with the photoconductive surface where it becomes attracted to the image area. The dry toner is removed from the non-image area and the remainder is transferred to a copy sheet. At this point, the transferred image must be made permanent by some type of fusing technique. The most prevalent means for fusing the dry toner onto the copy sheet has been by use of heat whereby the resin in the toner would be melted and thereby secured to the copy sheet or a combination of heat and pressure. Relatively recently, however, methods have been devised whereby the dry toner may be fused by the use of pressure only. Pressure fusing has distinct advantages including a lower energy requirement, greater safety, and less of an affect on the immediate environment of the copier. One disadvantage in pressure fusing that has been found is that there is a tendancy to cause creases or wrinkles in the copy sheet during fusing as a result of the high pressures to which the copy sheet is exposed. Obviously, it would be advantageous to reduce the possibility of such creasing during the pressure fusing.

SUMMARY OF THE INVENTION

A fusing station is provided with a pair of fuser rollers that are juxtaposed to one another under pressure. A vacuum plenum is placed at the nip of the rollers and in contiguous relation therewith such that a copy sheet may be directed across the plenum and toward the nip of the pressure fusing rollers thereby creating a drag on the sheet as it is acted upon by the rollers. This drag tends to straighten out the sheet thereby reducing the probability of crease formation. This combination is included in an electrostatic reproducing machine wherein a copy image of an original is produced, developed with a dry toner, and transferred to a copy sheet after which the copy sheet is conveyed over the plenum and toward the nip of the rollers.

DETAILED DESCRIPTION OF THE PREFERRED EMBODIMENT

Figure 1:
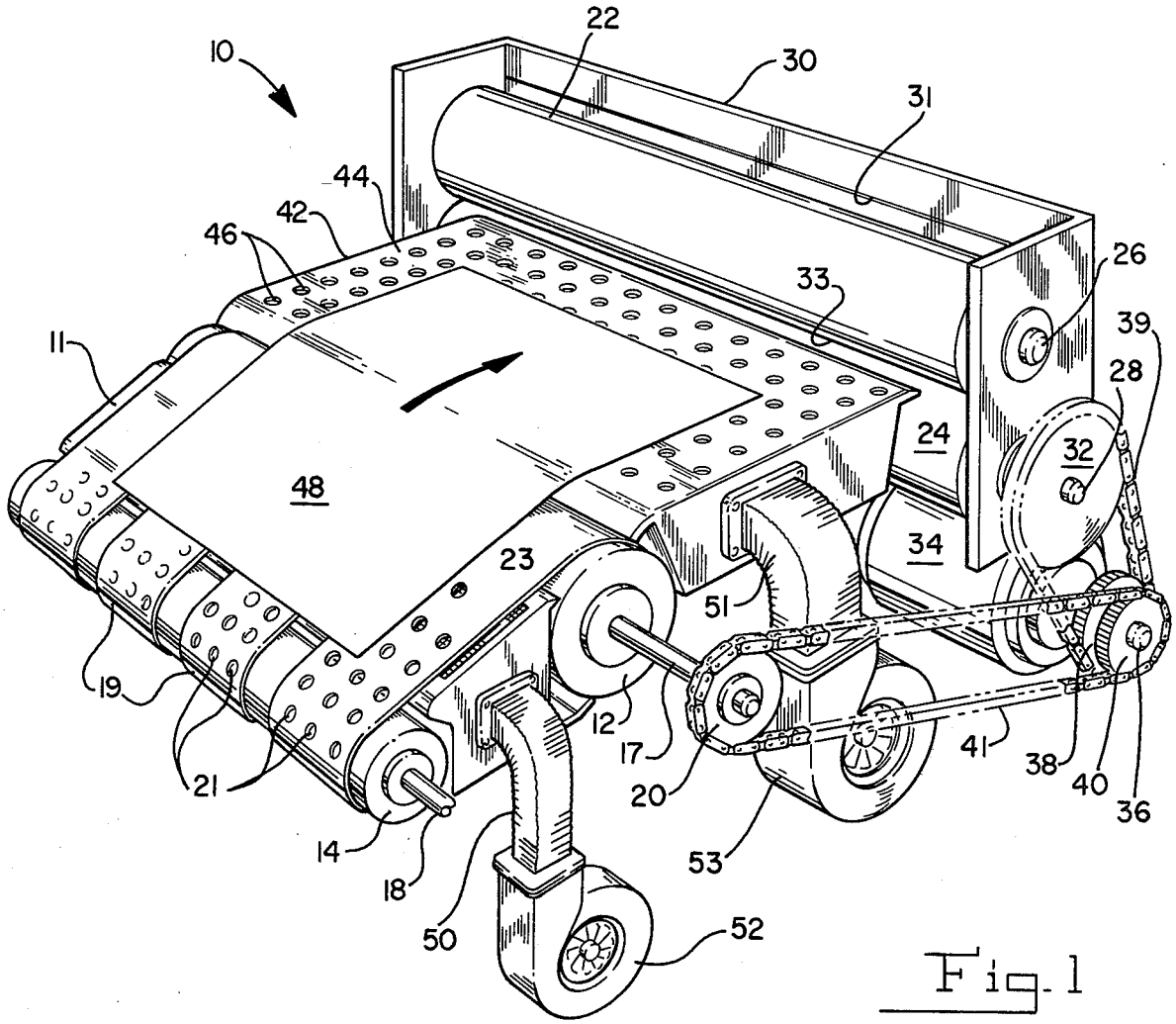
FIG. 1 is a perspective view of a pressure fusing unit that incorporates the features of the instant invention.

Referring now to the drawing, a pressure fusing apparatus is shown generally at 10 and includes a first plenum 11 having a pair of rollers 12 and 14 disposed upon opposite longitudinal ends thereof. The rollers 12, 14 are mounted on shafts 17 and 18 respectively, the shaft 17 having a sprocket 20 at one end thereof. These shafts 17, 18 are rotatably supported within a housing (not shown) of an electrostatic reproducing machine. A plurality of belts 19 having openings 21 therein are trained about the rollers 12, 14 to be conveyed across the plenum 11. The plenum 11 has a screen covered opening 23 at the top thereof.

A pair of juxtapositioned rollers 22 and 24 are mounted upon shafts 26 and 28, respectively, which shafts are rotatably supported by a frame 30 that has an opening 31 therein. These rollers 22 and 24 are spring loaded to engage one another under pressure to form a nip 33 therebetween and may be made of a material such as carbon steel. The shaft 28 has a sprocket 32 supported at one end outside of the frame 30. A motor 34 is supported by the frame 30 and has an output shaft 36 upon which a pair of sprockets 38 and 40 are mounted for rotation therewith. The motor 34 may be enabled and disabled by any convenient means but for the purpose of this description it will be assumed that the motor is in continuous operation. A chain 39 is trained about the sprockets 32 and 38 to provide drive from the motor 34 to the rollers 22, 24. A second chain 41 is trained about the sprockets 20, 40 to provide drive to the roller 12, and in turn to the belts 19.

Figure 2:
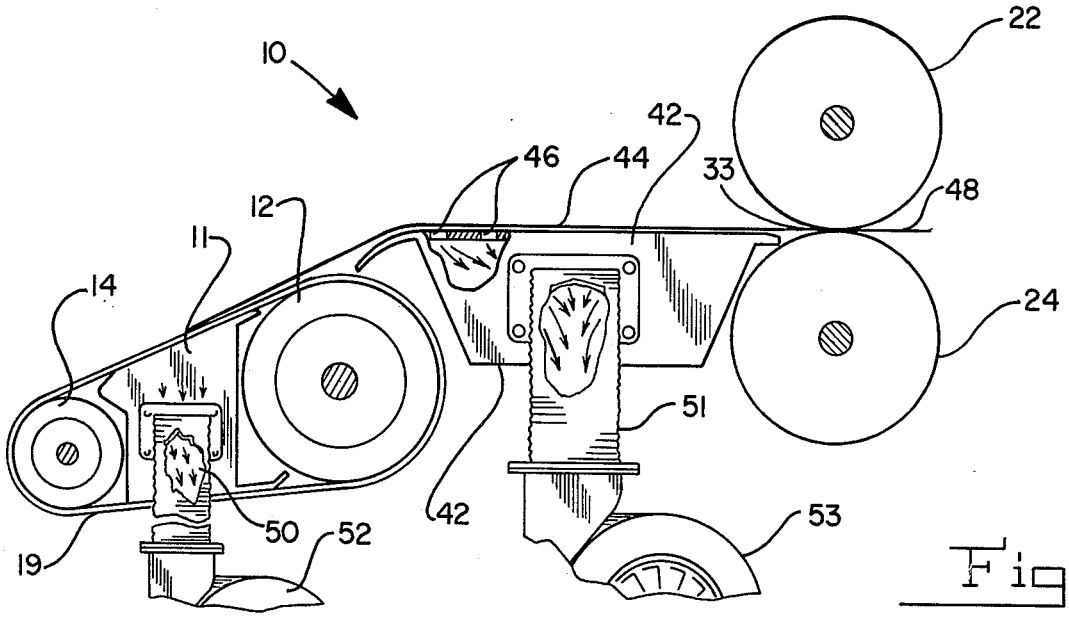
FIG. 2 is a longitudinal cross-sectional view of the apparatus shown in FIG. 1.

A second plenum 42 is located intermediate to the roller 12 and the nip 33 of the rollers 22, 24. The plenum 42 has a flat upper surface 44 having a plurality of openings 46 therein which surface may be of a low friction material such as a suitable fluoroethylene composition. A sheet 48 is shown in FIG. 1 partially located on the flat surface 44 and partially on the belts 19 and in FIG. 2 being drawn through the pressure rollers 22, 24. A pair of ducts 50 and 51 are each confluent with the plenums 11 and 42, respectively, and each is connected to a pump 52, 53, respectively, to create a vacuum within their respective plenums as shown by the arrows in FIG. 2.

In operation, a vacuum may be drawn on the first plenum 11 by the pump 52 thereby causing a sheet 48 to be held against the belts 19. The motor 34 would cause the sprocket 40 to rotate thereby providing drive to the sprocket 20 through the chain 41 to ultimately drive the belts 19 and convey a sheet 48 across the top of the plenum 11 and across the plenum 42. Because of the presence of the openings 21 in the belts and the vacuum in the plenum 11, the sheet will be held fast thereto. It will be appreciated that this unit is merely shown as a means for conveying a copy sheet and does not form a part of the instant invention as any conveying means that does not contact the unfused toner of the sheet 48 may be used without departing from the instant invention.

The belts 19 will convey a sheet 48 to the second plenum 42 where the sheet will be held to the flat surface 44 due to the presence of the openings 46 and the vacuum created by the pump 53. As the sheet 48 is conveyed across the flat, low friction surface 44 it will eventually be driven by the belt 19 into the nip 33 of the rollers 22, 24 to be pulled thereby. During the passage through the rollers 22, 24 any dry toner that is on the sheet 48 will be fused due to the pressure between the rollers. The pressure exerted upon the copy sheet 48 is preferably between 150 to 300 pounds per linear inch as measured along the nip 33. As a result of the vacuum in the plenum 42 a drag will be created upon the sheet 48 and the sheet will be held in a flat and aligned position thereby resulting in a reduction of the frequency with which creases are created in such sheets during pressure fusing. More specifically, some sheets tend to have ripples that would normally tend to cause undulations as the sheet is being driven through the pressure rollers.

These ripples may be caused by operator handling and/or humidity absorption. By keeping the sheet flat, i.e. straightening the sheet 48, as it is conveyed through the rollers 22, 24 such ripples are removed thereby lessening the chances for creasing of the sheet during pressure fusing. It will be appreciated that the plenum 42 should be immediately adjacent the nip 33 to assure the removal of any ripples in a sheet 48 and the plenum should be designed to achieve this relationship. Obviously, a unit with rollers, such as plenum 11, will not meet this requirement because the rollers negate the ability to provide a flat surface adjacent the nip 33.

What is claimed is:

1. Apparatus for pressure fusing dry toner on a sheet, comprising a plenum having a flat surface with openings therein, said flat surface having an upstream end and a downstream end, means for drawing a vacuum within said plenum, a pair of juxtapositioned rollers nip forming in engagement with one another under sufficient pressure to fuse the toner, said rollers being located immediately adjacent the downstream end of said flat surface, means for rotating at least one of said rollers, and means for conveying a sheet across said surface from said upstream end to said downstream end and into the nip of said rollers, said vacuum means causing a sheet to be held flat against said surface and creating a drag on such sheet as the sheet is driven through said pressure rollers.

2. The apparatus of claim 1 wherein said flat surface is made of a low friction material.

3. In a method of pressure fusing a dry toner image on a sheet, comprising:

(a) Creating a vacuum in a plenum having a flat surface with a plurality of openings in such surface and having an upstream end and a downstream end;

(b) Placing a pair of juxtapositioned rollers under pressure to one another immediately adjacent the downstream end of the flat surface;

(c) Rotating the rollers;

(d) Conveying a sheet having a dry toner image thereon across the plenum and into the nip of the rotating rollers to be driven thereby; and (e) Creating a drag on the sheet as it is driven across the flat surface by the rotating rollers.

4. In an electrostatic reproducing machine wherein a copy of an original is produced by creating an image on the copy sheet and developing the image with dry toner, the combination comprising a plenum having a flat surface with an upstream end and a downstream end and with openings therein, means for drawing a vacuum within said plenum, a pair of juxtapositioned rollers in nip forming engagement with one another under pressure placed in contiguous relation to said downstream end of said flat surface, means for rotating at least one of said rollers, and means for conveying a sheet across said surface from said upstream end to said downstream end and into the nip of said rollers, said vacuum means causing a sheet to be held flat against said flat surface and creating a drag on such sheet as the sheet is driven through said pressure rollers.

* * * * *